US006612562B2

(12) United States Patent
Sloan, Jr. et al.

(10) Patent No.: US 6,612,562 B2
(45) Date of Patent: Sep. 2, 2003

(54) METHOD AND SYSTEM FOR FEEDING MEDIA TO A PRINTER

(75) Inventors: Richard A. Sloan, Jr., Southbury, CT (US); Paul R. Sette, Branford, CT (US); Linda L. Gale, Fairfield, CT (US)

(73) Assignee: Pitney Dowes Inc., Stamford, CT (US)

( * ) Notice: Subject to any disclaimer, the term of this patent is extended or adjusted under 35 U.S.C. 154(b) by 0 days.

(21) Appl. No.: 09/683,413

(22) Filed: Dec. 21, 2001

(65) Prior Publication Data

US 2003/0116903 A1 Jun. 26, 2003

(51) Int. Cl.[7] ..... B65H 5/00

(52) U.S. Cl. ..... 271/10.09; 271/110; 271/114; 271/124; 271/145; 271/167

(58) Field of Search ..... 271/10.01, 10.09, 271/110, 114, 116, 124, 145, 165, 167

(56) References Cited

U.S. PATENT DOCUMENTS

| | | | | | |
|---|---|---|---|---|---|
| 3,947,015 | A | | 3/1976 | Funk et al. | 271/9 |
| 4,350,330 | A | * | 9/1982 | Brown | 271/12 |
| 4,362,100 | A | | 12/1982 | Wu et al. | 101/233 |
| 4,444,385 | A | | 4/1984 | Berry | 271/22 |
| 4,522,382 | A | | 6/1985 | Chu et al. | 270/1.1 |
| 4,522,385 | A | * | 6/1985 | Stefansson | 271/116 |
| 4,523,869 | A | | 6/1985 | Martin | 400/629 |
| 4,652,161 | A | | 3/1987 | Crean et al. | 400/625 |
| 4,693,620 | A | | 9/1987 | Harumatsu | 400/611 |
| 4,715,595 | A | | 12/1987 | Ishigaki | 271/110 |
| 4,729,680 | A | | 3/1988 | Osterlund et al. | 400/624 |
| 4,733,310 | A | | 3/1988 | Kapp et al. | 358/300 |
| 4,834,277 | A | | 5/1989 | Gomoll et al. | 226/101 |
| 4,844,638 | A | | 7/1989 | Kagami et al. | 400/636 |
| 4,859,098 | A | | 8/1989 | Kawashima et al. | 400/616 |
| 4,881,837 | A | | 11/1989 | Falconieri et al. | 400/625 |
| 4,958,950 | A | | 9/1990 | Kobayashi et al. | 400/629 |
| 4,995,745 | A | | 2/1991 | Yokoi et al. | 400/605 |
| 5,014,973 | A | * | 5/1991 | Markert | 271/165 |
| 5,022,642 | A | * | 6/1991 | Hasegawa et al. | 271/110 |
| 5,042,953 | A | | 8/1991 | Thurner et al. | 400/637.6 |
| 5,071,273 | A | | 12/1991 | Kato | 400/582 |
| 5,192,067 | A | | 3/1993 | Saito | 271/10 |
| 5,375,826 | A | | 12/1994 | Flores | 271/10 |
| 5,443,359 | A | * | 8/1995 | Miller et al. | 271/114 |
| 5,457,524 | A | | 10/1995 | Metcalf et al. | 355/309 |
| 5,573,235 | A | | 11/1996 | Asai | 271/121 |
| 5,615,873 | A | | 4/1997 | Kobayashi et al. | 271/121 |
| 5,664,771 | A | * | 9/1997 | Nagatani et al. | 271/116 |
| 5,692,744 | A | | 12/1997 | Funato | 271/242 |
| 5,704,605 | A | | 1/1998 | Yasuoka | 271/9.02 |
| 5,769,408 | A | * | 6/1998 | Selak et al. | 271/116 |
| 5,793,177 | A | | 8/1998 | Chia | 318/685 |
| 5,806,843 | A | | 9/1998 | Hansen et al. | 271/3.03 |
| 5,860,616 | A | | 1/1999 | Lamothe | 242/564.1 |
| 5,884,909 | A | | 3/1999 | Umeda | 271/242 |
| 5,893,556 | A | | 4/1999 | Akahane et al. | 271/126 |
| 5,938,355 | A | | 8/1999 | Suzuki | 400/624 |
| 5,992,843 | A | | 11/1999 | Lee | 271/170 |
| 5,992,846 | A | | 11/1999 | Umeda | 271/248 |
| 6,062,558 | A | * | 5/2000 | Takahashi | 271/165 |
| 6,082,730 | A | | 7/2000 | Campbell et al. | 271/171 |
| 6,086,061 | A | * | 7/2000 | Vedoy et al. | 271/3.01 |
| 6,105,953 | A | | 8/2000 | Komuro | 271/9.09 |
| 6,412,770 | B1 | * | 7/2002 | Demmeler | 271/124 |

OTHER PUBLICATIONS

U.S. Statutory Invention Registration—Registration No. H17; Published Feb. 4, 1986.

* cited by examiner

*Primary Examiner*—David H. Bollinger
(74) *Attorney, Agent, or Firm*—George M. Macdonald; Angelo N. Chaclas; Charles R. Malandra

(57) ABSTRACT

A media feed system with a self-contained propulsion system is provided. A singulator is used to feed a single media piece and a sensor determined when to disengage propulsion.

6 Claims, 7 Drawing Sheets

METHOD AND SYSTEM FOR FEEDING MEDIA TO A PRINTER

BACKGROUND OF INVENTION

The embodiments described herein relate generally to media feeding systems and more specifically to systems and methods for feeding variable size media to a printer.

Certain printers are known that have several delivery paper feed paths for feeding paper into a print engine feed path. For example, certain printers have a paper source under the horizontal print engine such that paper is pulled from the source tray and curled around the back of the printer and then fed into the horizontal print engine feed path. Some printers utilize more than one paper tray in order to accommodate different paper sizes. Such a design minimizes the amount of area of a surface required for the footprint at the expense of using more space in a vertical direction. Conventional printers often provide a paper feed bypass tray that provides paper at a close to horizontal feed path to the print engine feed path. A bypass feed path does not necessarily have to be horizontal to the print engine feed path. An inkjet printer has a generally small print engine band that requires the paper be parallel to the print head. An example of a description of a printing feed mechanism that incorporates a horizontal envelope feeder is shown in U.S. Pat. No. 4,733,310 issued Mar. 22, 1988 to Kapp, et al.

As can be appreciated, conventional paper trays feed paper from the top of the stack of paper and must be removed from the printer in order to feed additional paper into the tray.

SUMMARY OF INVENTION

In one embodiment, a media feeder includes a propulsion source and singulator to feed single media items from a stack.

In another embodiment, the media feeder includes a power source, receives a feeder control signal and feeds media from the bottom of a stack.

In another embodiment, the media feeder includes at least two media sources and a control mechanism to control which source to utilize for a subsequent feed.

DETAILED DESCRIPTION

The present application describes embodiments of a system and method for feeding media. The embodiments are illustrative and where alternative elements are described, they are understood to fully describe alternative embodiments without repeating common elements. The processes described provide useful results including but not limited to increasing print accuracy, optimizing printer throughput and simplifying maintenance. The embodiments discussed herein apply to an envelope feeding system for an inkjet printer for illustrative purposes. For illustrative purposes, an inkjet printer having a horizontal bypass feed port in the rear of the unit is the target device. Of course the target may be the main paper path of the device as well and may load a traditional paper source for a printer. Similarly, a Laser printer or other device requiring sheet fed media may be used as an appropriate target device.

As can be appreciated, moderately priced inkjet printers may not include robust media feed systems. They typically incorporate one media tray that has a moderate capacity. When a paper tray is utilized, the printer feeds sheet from the bottom of the stack and the printer must be interrupted to load additional sheets into the paper tray. Similarly, the conventional feed mechanisms are passive devices without a separate source of media propulsion.

The embodiments described herein utilize a media feeding system that is preferably configured to feed standard number 10 envelopes in a face up orientation. with the bottom major edge fed first into the feed path. Such envelopes are 4 and one-eighth inch on the minor edge and 9 and one half inch on the major edge. Other substrates and other sizes of paper and envelopes may be processed, but the number 10 envelope is used for illustrative purposes. In a later embodiment, two envelopes are simultaneously fed along their minor edge such that a number 9 and a number 11 envelope may be simultaneously fed to a printer. Components of media feed mechanisms and singulators are known and not described in detail in this application. However, a fourth embodiment described below uses a single feed mechanism to feed from two separate media sources.

Figure 1A:
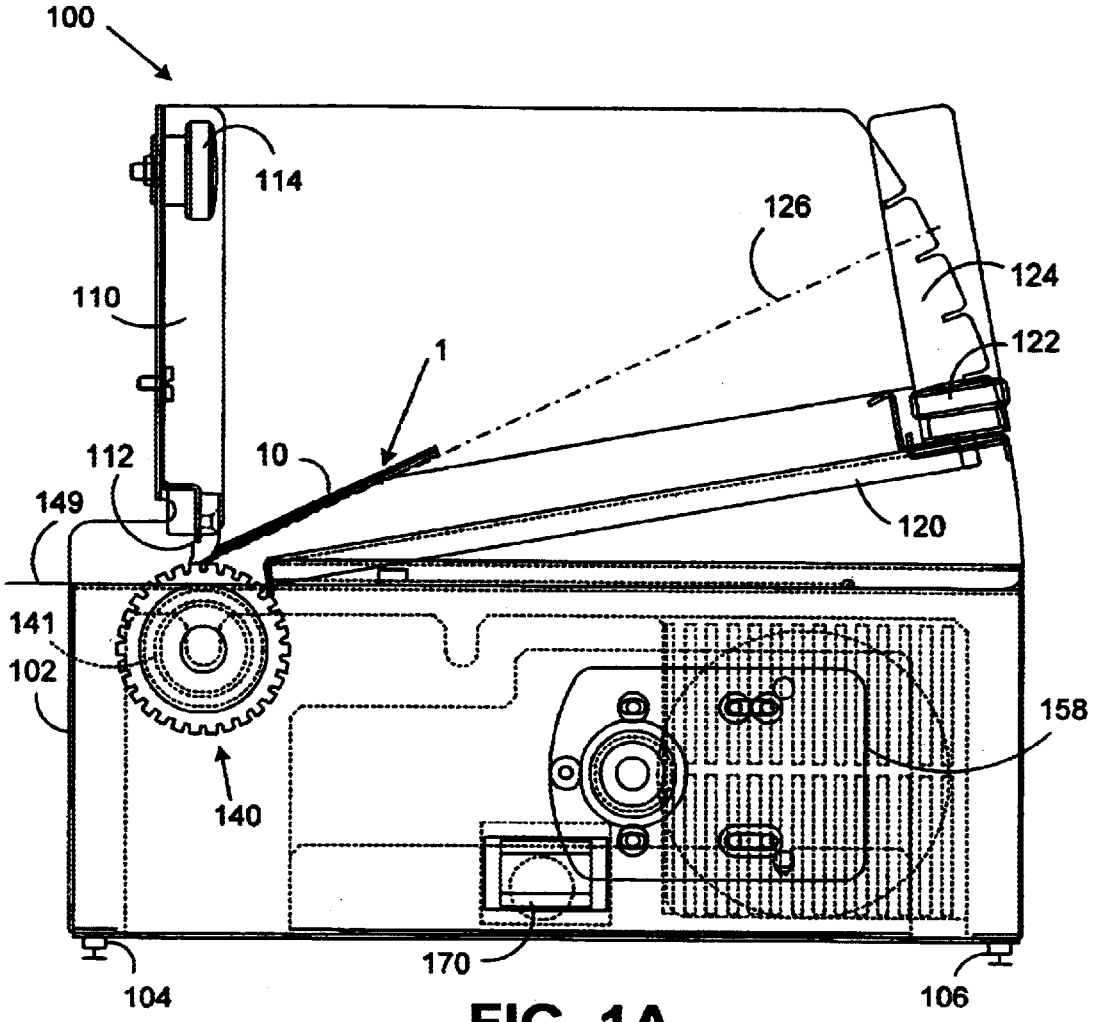
FIG. 1A is a side view of a media feeder according to an embodiment of the present application.
Figure 1B:
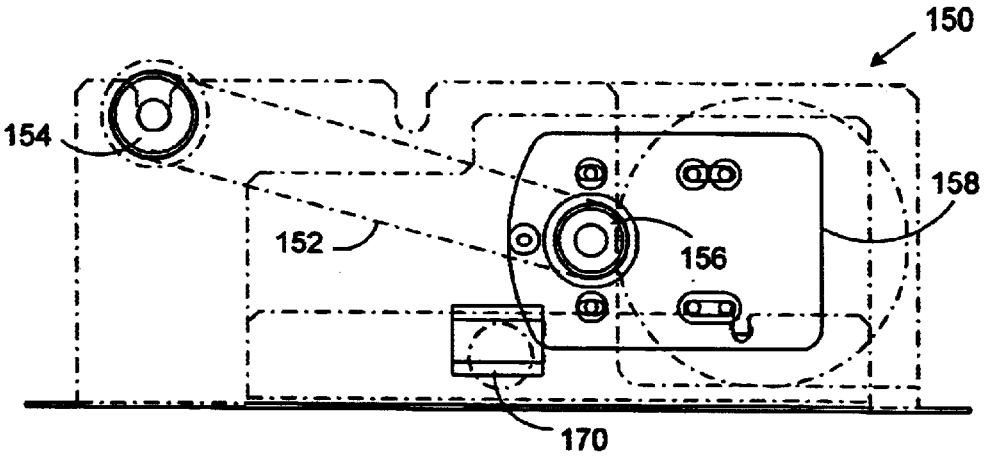
FIG. 1B is a side view of propulsion system for a media feeder according to an embodiment of the present application shown in FIG. 1A.

Referring to FIG. 1A, a first embodiment-is shown. A media feeder 100 is described for singulating and feeding a media piece 10 from a stack of media 1. The media piece will be fed until a resistance is sensed in forcing the paper through the feed path using a slip clutch 141. As can be appreciated, if the media feeder is forcing a sheet of paper into the bypass feed rollers of a printer when the bypass feed rollers are not moving, the sheet of paper will stop at that point until the bypass feed rollers start moving. In an alternative embodiment, the media feeder does not sense resistance in the fed media, but feeds the media on a predetermined schedule or according to a command response from an external device. In another alternative embodiment, the media feeder does not sense resistance in the fed media, but feeds the media on a predetermined schedule or according to a command response from an external device. A controller (not shown) may be used to determine a feed schedule or interpret feed commands from an external device.

The media feeder 100 includes a singulator 110 that is adjustable to the thickness of the media such that a singulating clearance will ensure that only one sheet of 10 is fed at a time. The media may be an envelope or sheet of paper or other media and may be interchangeably used in the description below. For example, singulator bar 112 is used to create a feed gap. The singulator bar is attached to the frame of the singulator 110 that is adjustable using knob 114 attached to the frame 102 of the media feeder 100. The frame 102 is fully adjustable along all axes and may be moved from side to side. Adjustable supports 104 are on each side of frame 102 and adjustable supports 106 are on each side of frame 102. Roller 140 feeds the media from feed tray system 120. The feed tray system 120 is a bin feeder in that it can be fed from the top while the unit is operating. The feed tray system 120 has a feed deck 126 for holding the media and is adjustable along a feed deck height adjuster frame 124 that is connected to the frame 102. Knob 122 is used to adjust the height of the feed deck 126 by moving the deck to a new notch in the feed deck height adjuster frame 124.

Referring to FIB. 1B, the propulsion system 150 is described. Power is obtained through a line connection to power connector 170 that supplies power to a power supply (not shown). The controller (not shown) controls the AC electric motor 158 in the propulsion system 150. The motor 158 may be reversible. Electric motor 158 drives wheel 156 that drives belt 152 that drives wheel 154. Wheel 154 drives roller 140 and uses a slip clutch to sense a force feedback on the media. The media is fed along adjustable guide 149 that is used to align the fed media with the target device. The roller 140 may be disengaged from the drive when the sheet is fed into the ready position so that the target device may easily pull the remainder of the sheet from the stack. Alternatively, the roller 140 may be engaged to feed the rest of the sheet.

Figure 2:
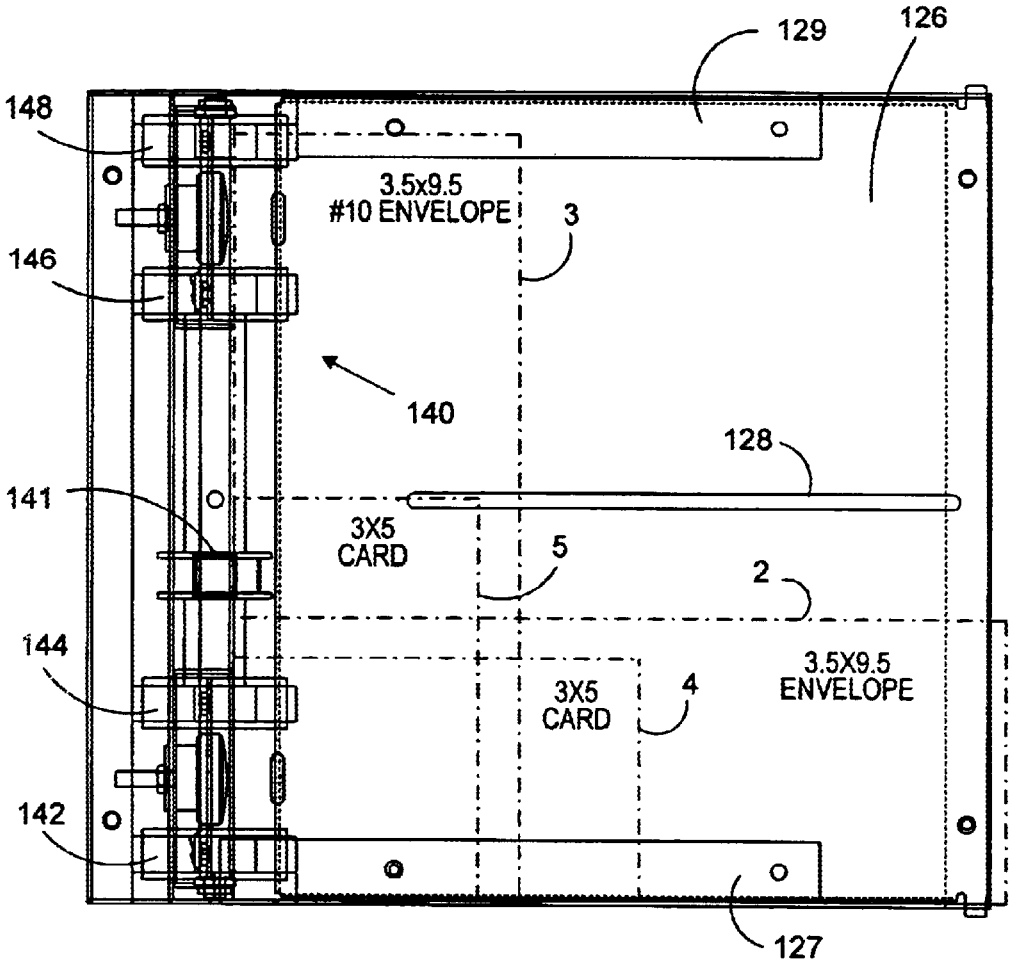
FIG. 2 is a top view of a media feeder according to an embodiment of the present application shown in FIG. 1A.

Referring to FIG. 2, the feed deck 126 is shown from the top to illustrate the ability to accommodating different media sizes. A guide rail 128 may be used to align the media. In alternatives, the media may be registered to either side rail 127, 129 or center justified using two adjustable guide rails (not shown). The roller system 140 includes multiple rollers 142, 144, 146, 148. In an alternative a single full width roller is used.

In an alternative embodiment, a DC electric motor may be used. As can be appreciated, other forms of propulsion may be employed including energy stored in a spring. Similarly, media biasing systems are known and not described in detail. A spring-loaded magazine may be used and a gravity feed mechanism may be used.

Figure 3:
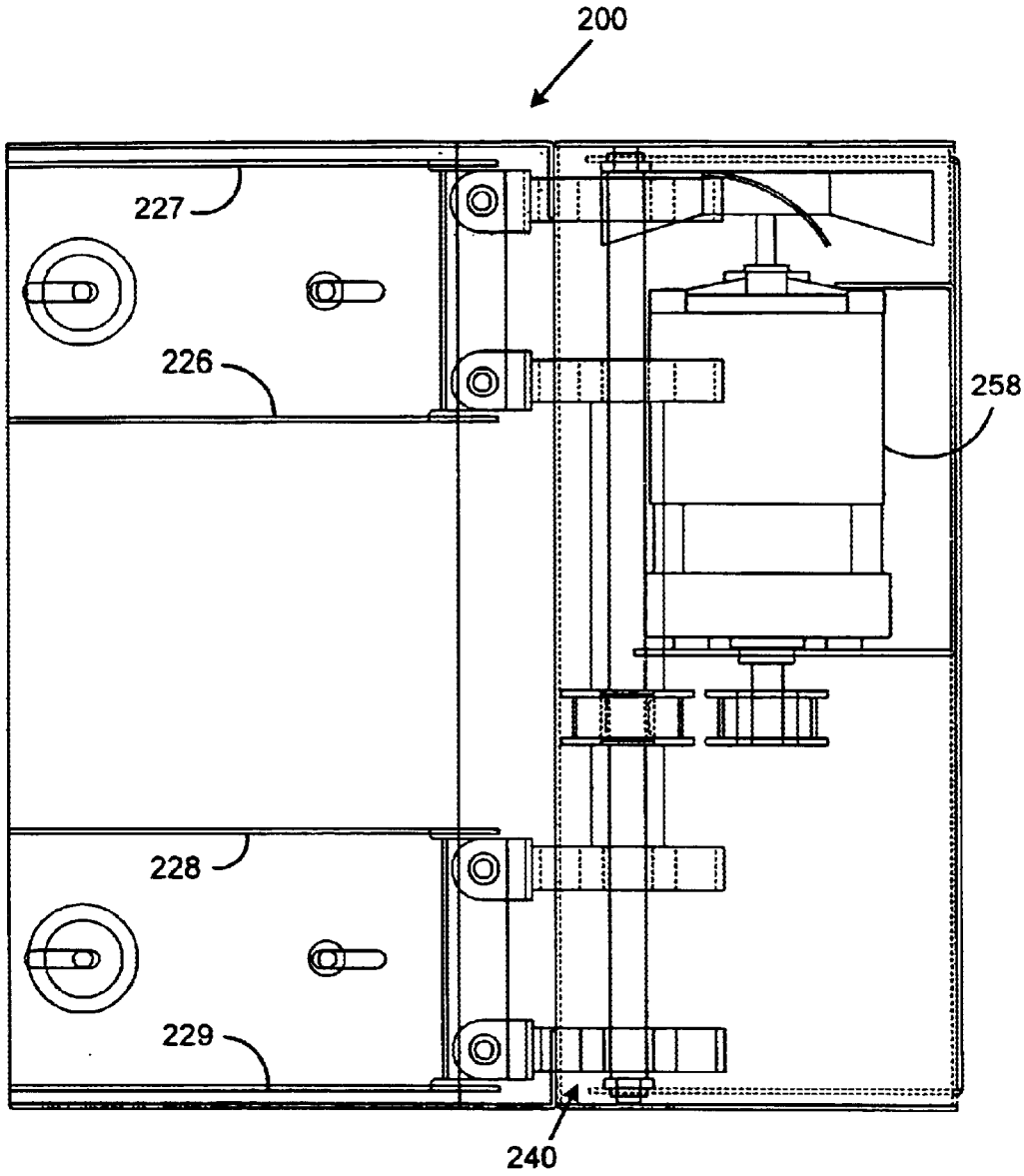
FIG. 3 is a top view of a media feeder according to a second embodiment of the present application.

Referring to FIG. 3, a second embodiment is described. The media feeder 200 has an electric motor 258 that drives roller system 240 to simultaneously feed media from two different stacks enclosed by a first set of rails 228, 229 and a second set of rails 226, 227.

Figure 4:
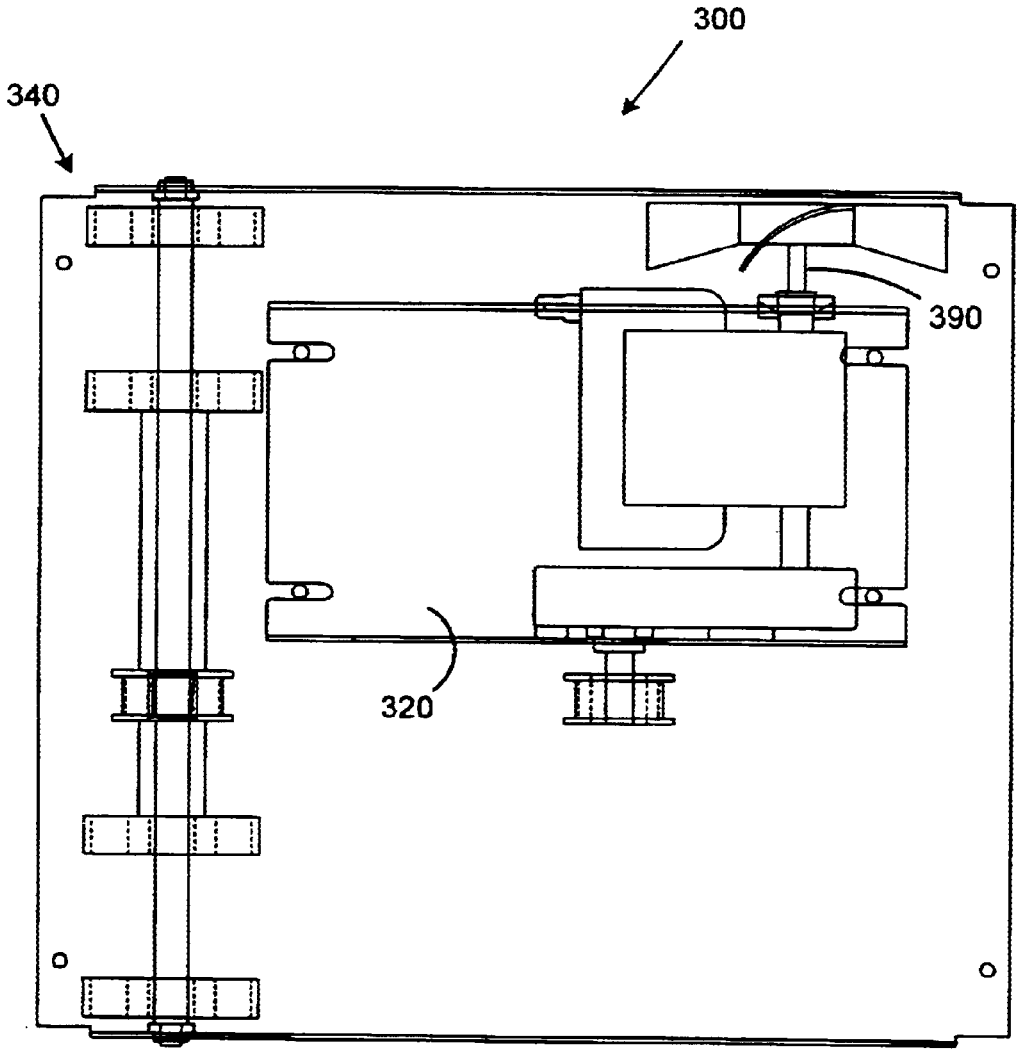
FIG. 4 is a top view of a media feeder according to a third embodiment of the present application.

Referring to FIG. 4, a third embodiment is described. The media feeder 300 has an electric motor (not shown) that drives roller system 340 to feed media from a movable stack 320 that may be automatically moved from side to side and vertically using drive 390 under the control of a controller (not shown).

Figure 5:
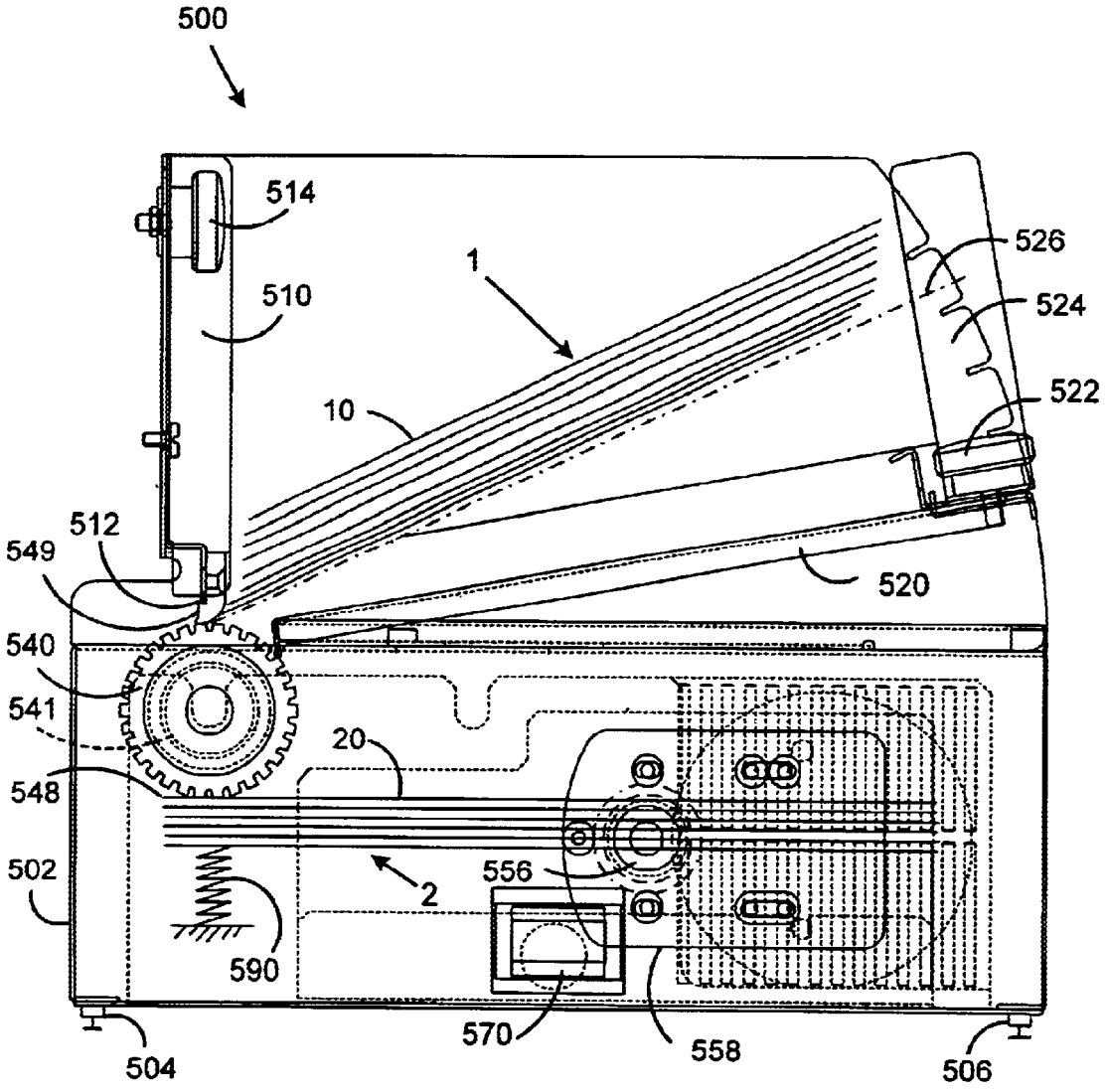
FIG. 5 is a side view of a media feeder according to a fourth embodiment of the present application.

Referring to FIG. 5, a fourth embodiment is shown. A media feeder 500 is described for singulating and feeding a media piece 10 from a stack of media 1 and for singulating and feeding a media piece 20 from a second stack of media 2. The media piece 1, 2 will be fed until a resistance is sensed in forcing the paper through the feed path using a slip clutch 541. As can be appreciated, if the media feeder is forcing a sheet of paper into the bypass feed rollers of a printer when the bypass feed rollers are not moving, the sheet of paper will stop at that point until the bypass feed rollers start moving. In an alternative embodiment, the media feeder does not sense resistance in the fed media, but feeds the media on a predetermined schedule or according to a command response from an external device. In another alternative embodiment, the media feeder does not sense resistance in the fed media, but feeds the media on a predetermined schedule or according to a command response from an external device. A controller (not shown) may be used to determine a feed schedule or interpret feed commands from an external device. The media being fed 1, 2 is directed using adjustable guide 549 and adjustable guide/singulator 548. The guides direct the direction of the media that is being fed into the target device.

The media feeder 500 includes a first singulator 510 that is adjustable to the thickness of the media such that a singulating clearance will ensure that only one sheet of media is fed at a time. For example, singulator bar 512 is used to create a feed gap. The singulator bar is attached to the frame of the singulator 510 that is adjustable using knob 514 attached to the frame 502 of the media feeder 500. The frame 502 is fully adjustable along all axes and may be moved from side to side. Adjustable supports 504 are on each side of frame 502 and adjustable supports 506 are on each side of frame 502. Roller 540 feeds the media from feed tray system 520. The feed tray system 520 is a bin feeder in that it can be fed from the top while the unit is operating. The feed tray system 520 has a feed deck 526 for holding the media and is adjustable along a feed deck height adjuster frame 524 that is connected to the frame 502. Knob 522 is used to adjust the height of the feed deck 526 by moving the deck to a new notch in the feed deck height adjuster frame 524.

The propulsion system obtains power through a line connection to power connector 570 that supplies power to a power supply (not shown). The controller (not shown) controls the AC electric motor 558 in the propulsion system. The motor 558 is reversible. Electric motor 558 drives wheel 556 in a first direction that drives a belt (not shown) that drives roller 540 in a first direction and uses a slip clutch 541 to sense a force feedback on the media. The media is fed along adjustable guide 549 that is used to align the fed media with the target device.

Alternatively, the controller (not shown) reverses the direction of the motor to move roller 540 in the opposite direction to feed media 20 from stack 2 using singulator/guide 548. Deck 520 prevents the top stack media 1 from being fed back into the media feeder 500. A spring mechanism 590 feeds media stack 20 up to the roller 540.

As can be appreciated, a mechanical switch could be used to select the stack to feed from. In an alternative, a set sequence can be loaded into the media feeder 500 and used to select the source of media. Additionally, an external control signal may be utilized to control the feed source, or the system may feed media at a predetermined rate.

Figure 6:
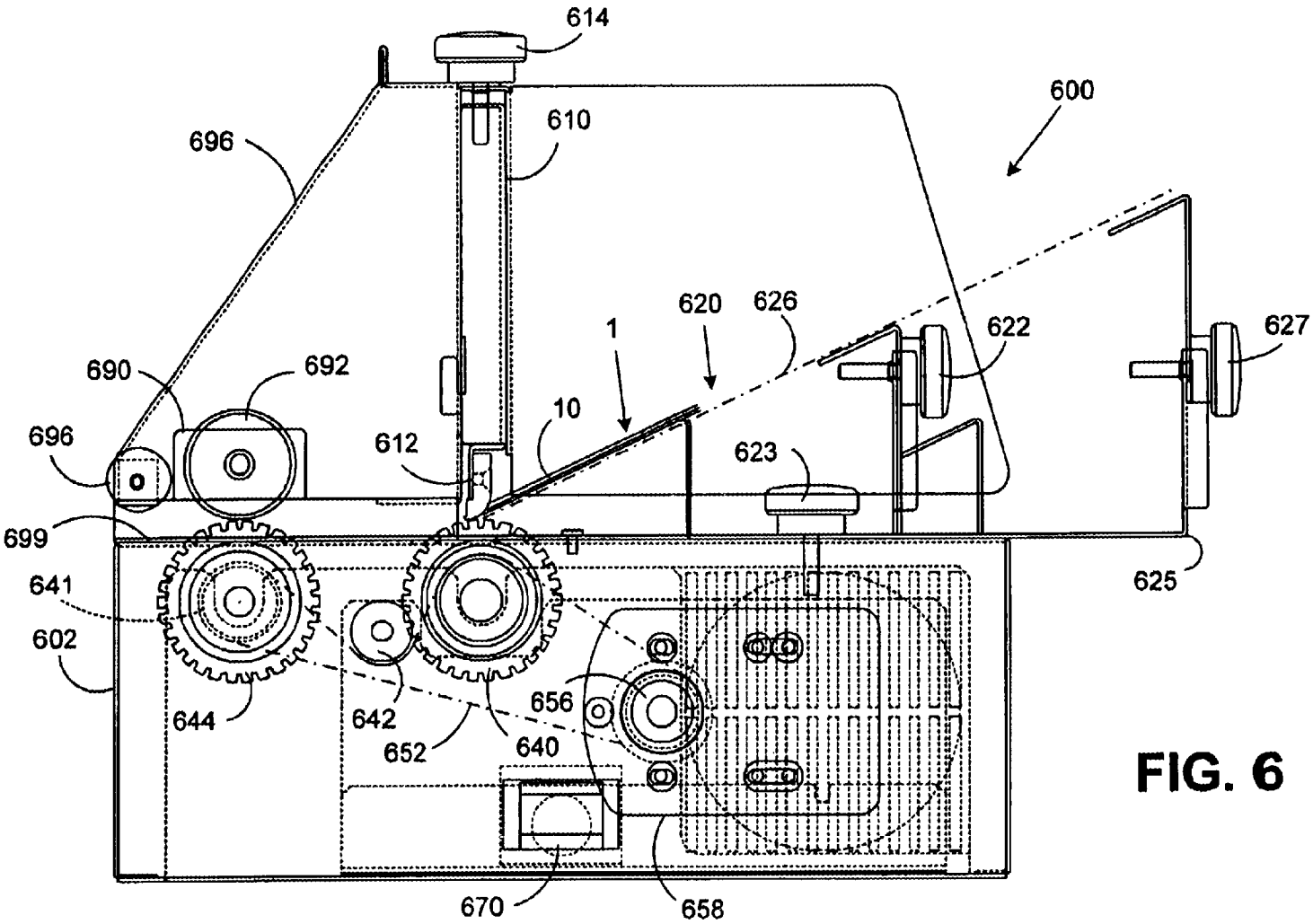
FIG. 6 is a side view of a media feeder according to a fifth embodiment of the present application.

Referring to FIG. 6, a fifth embodiment is shown. A media feeder 600 is described for singulating and feeding a media piece 10 from a stack of media 1. The media piece will be fed until the system determines it should stop. The media feeder 600 uses a slip clutch 641 to sense a resistance when the paper hits a stop. Additionally, a paper position sensor 692 detects if paper is in the exit path. Wheel 692 is used as a sensor and guide and housing 690 includes an optical media sensor. A controller (not shown) is used to determine when to engage drive rollers 640, 644 using motor 658 and belt 652 with clutches (not shown).

The media feeder 600 includes a singulator 610 that is adjustable to the thickness of the media such that a singulating clearance will ensure that only one sheet of is fed at a time. For example, singulator bar 612 is used to create a feed gap. The singulator bar is attached to the frame of the singulator 610 that is adjustable using knob 614 attached to the frame 602 of the media feeder 600. Rollers 640, 644 feed the media from feed tray system 620. The feed tray system 620 is a bin feeder in that it can be fed from the top while the unit is operating. The feed tray system 620 has a feed deck 626 for holding the media and is adjustable along a feed deck height adjuster frame and knob 623 that is connected to the frame 602. Knob 622 is used to adjust the height of the feed deck 626 by moving the deck 626 to a new notch in the support. Deck extender 625 is controlled using knob 627. The feeder frame 696 is connected to frame 602.

Power is obtained through a line connection to power connector 670 that supplies power to a power supply (not shown). The controller (not shown) controls the AC electric motor 658 in the propulsion system. The motor 658 may be reversible. Electric motor 658 drives wheel 656 that drives belt 652 that drives rollers 640, 644 using tensioner 642 that is used to sense a force feedback on the media. The media is fed along output deck 699 that is used to align the fed media with the target device.

The second roller 644 may be disengaged from the drive when the sheet 10 is fed into the ready position so that the target device may easily pull the remainder of the sheet from the stack while the first roller 640 is ready to start feeding another sheet 10. Alternatively, the roller 140 may be engaged to feed the rest of the sheet.

The system includes sensors (not shown) to sense carriage speed and position.

Figure 7:
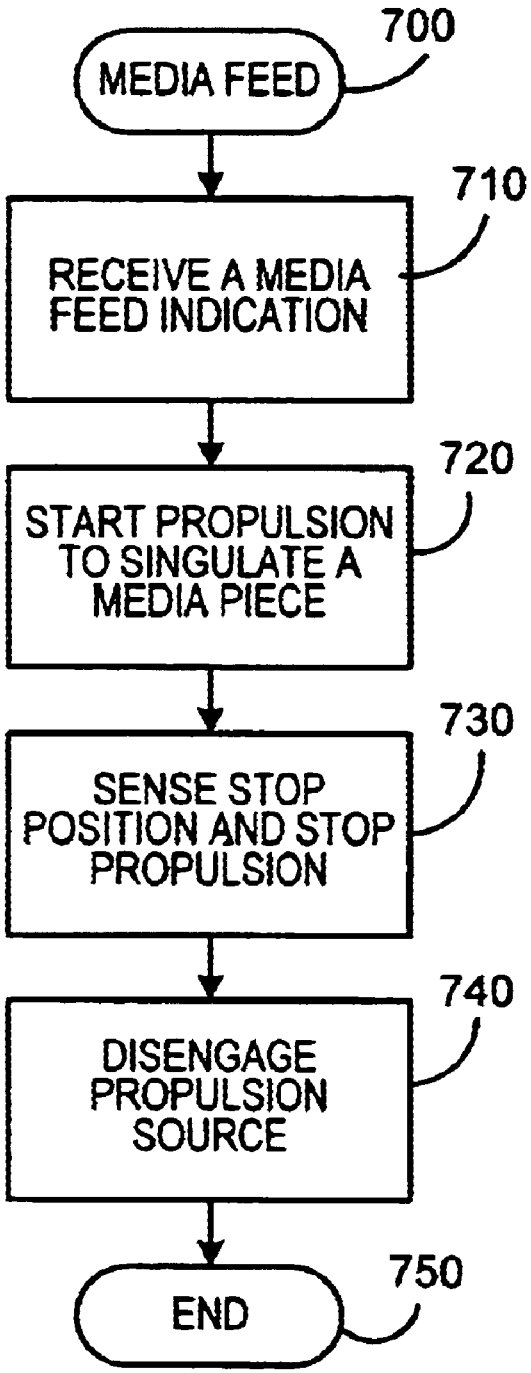
FIG. 7 is a flowchart of a media feed process according to another embodiment of the present application.

Referring FIG. 7, another embodiment is shown. The process for feeding 700 starts a media feed. In step 710, the system receives a media feed indication. In step 720, the system starts a propulsion system to singulate a media piece. In step 730, the system senses a stop and stops the propulsion. In step 740, the system disengages the propulsions source and ends in step 750.

Power supplies are well known and not described in detail. As can be appreciated, a battery or electrical energy storage device may be utilized as a source of electrical power. Similarly, controllers are well known and not described in detail. In one embodiment, an 8051 controller and support circuitry is utilized.

The above specification describes a new system and method for feeding media that is useful and may increase throughput speed and/or accuracy of the system.

The described embodiments are illustrative and the above description may indicate to those skilled in the art additional ways in which the principles of this invention may be used without departing from the spirit of the invention. Accordingly the scope of the claims should not be limited by the particular embodiments described.

What is claimed is:

1. A method for feeding media comprising:

receiving a media feed indication from an external source;

starting an internal propulsion system in response to the media feed indication to singulate and feed a media piece sensing an appropriate stop position; and disengaging the internal propulsion system, wherein a slip clutch is used to sense the appropriate stop position.

2. A media feeding system comprising:

a frame;

a propulsion system connected to the frame for feeding a media piece;

a media stack deck;

a singlulator for removing the media piece from a stack on the media stack deck; and a media piece stop position sensor, wherein the propulsion system includes an AC electric motor and a power supply and wherein the media stop position sensor includes a slip clutch.

3. A method for feeding media comprising:

receiving a media feed indication;

starting a propulsion system to singulate and feed a media piece;

sensing an appropriate stop position using a slip clutch; and disengaging the propulsion system.

4. The method of claim 3, wherein the media feed indication is received from an external source.

5. The method of claim 4, wherein the media feed indication is received by a processor.

6. The method of claim 5, wherein the propulsion system is controlled by the processor using the media feed indication received from the external source.

* * * * *